US011371332B2

(12) United States Patent
Xiao et al.

(10) Patent No.: US 11,371,332 B2
(45) Date of Patent: Jun. 28, 2022

(54) SAND ACCUMULATORS TO AID DOWNHOLE PUMP OPERATIONS

(71) Applicant: SAUDI ARABIAN OIL COMPANY, Dhahran (SA)

(72) Inventors: Jinjiang Xiao, Dhahran (SA); Musa Alnafisah, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 252 days.

(21) Appl. No.: 16/851,633

(22) Filed: Apr. 17, 2020

(65) Prior Publication Data

US 2021/0324722 A1 Oct. 21, 2021

(51) Int. Cl.

| | |
|---|---|
| ***E21B 27/00*** | (2006.01) |
| ***E21B 43/12*** | (2006.01) |
| ***E21B 43/38*** | (2006.01) |
| ***E21B 34/08*** | (2006.01) |
| ***E21B 21/10*** | (2006.01) |
| ***E21B 37/00*** | (2006.01) |
| ***E21B 33/12*** | (2006.01) |

(52) U.S. Cl.
CPC ..... *E21B 43/38* (2013.01)

(58) Field of Classification Search
None
See application file for complete search history.

(56) References Cited

U.S. PATENT DOCUMENTS 6,322,616 B1 11/2001 Kennedy et al.
9,228,414 B2 * 1/2016 Xu ..... E21B 34/14
9,441,435 B2 9/2016 Leitch
(Continued)

FOREIGN PATENT DOCUMENTS

CN 203891849 U 10/2014
CN 106761592 A 5/2017
(Continued)

OTHER PUBLICATIONS

ADV (Automatic Diverter Valve), RMS pumptools, product page, Accessed Apr. 17, 2020, URL: http://www.rmspumptools.com/products/automatic-diverter-valve.php (7 pages).
(Continued)

*Primary Examiner* — Matthew Troutman
*Assistant Examiner* — Douglas S Wood
(74) *Attorney, Agent, or Firm* — Osha Bergman Watanabe & Burton LLP

(57) ABSTRACT

A first sand accumulator may include a housing and an insert within the housing. The insert includes axially aligned outer and inner sleeves. In a first position, the outer and inner sleeves both have large flow ports that align to form a continuous flow path for fluid to flow through the sand accumulator such that a vortex flow forms in the sand accumulator. A second sand accumulator may include a housing disposed in line with a wellbore tubular and an insert disposed inside the housing such that insert forms a continuous end-to-end seal with a section of the wellbore tubular. An inlet section of the insert has an inlet port configured to permit fluid flow such that a vortex flow forms in the inlet section. A method of using a sand accumulator includes introducing process fluid entrained with sand to the sand accumulator.

20 Claims, 5 Drawing Sheets

(56) References Cited

U.S. PATENT DOCUMENTS

| | | | | |
|---|---|---|---|---|
| 10,082,014 | B2 | 9/2018 | Fielder, III et al. | |
| 2002/0129935 | A1 | 9/2002 | Castano-Mears et al. | |
| 2006/0011345 | A1 | 1/2006 | Delaloye et al. | |
| 2011/0100624 | A1 | 5/2011 | Ford | |
| 2012/0061073 | A1 | 3/2012 | Soni et al. | |
| 2012/0273278 | A1 | 11/2012 | Zhu | |
| 2013/0168091 | A1* | 7/2013 | Xu | E21B 27/00 166/99 |
| 2013/0284423 | A1* | 10/2013 | Morrison | E21B 43/38 166/105.5 |
| 2017/0328190 | A1 | 11/2017 | Fielder, III et al. | |
| 2018/0283155 | A1 | 10/2018 | Saponja et al. | |
| 2019/0106973 | A1 | 4/2019 | Ayub et al. | |
| 2019/0153847 | A1* | 5/2019 | Webber | E21B 43/126 |
| 2020/0141223 | A1* | 5/2020 | Brown | E21B 34/14 |

FOREIGN PATENT DOCUMENTS

| | | | |
|---|---|---|---|
| CN | 109356562 | A | 2/2019 |
| CN | 109488277 | A | 3/2019 |
| WO | 2017160291 | A1 | 9/2017 |
| WO | 2018052470 | A1 | 3/2018 |

OTHER PUBLICATIONS

"Sand Management System", Forum MulitLift Solutions: Artificial Lift Solutions, Forum Energy Technologies, product page, Accessed Apr. 17, 2020, URL: https://www.f-e-t.com/products/completions/well-completion/artificial-lift-solutions/sand-management (1 page).

"SandRight® Solids Fallback Preventer: Sand Management Tool", Electric Submersible Pumps, Halliburton, Dec. 2019, URL: https://www.halliburton.com/content/dam/ps/public/artificial_lift/contents/Data_Sheets/web/SandRight-solids-fallback-preventer.pdf (2 pages).

International Search Report and Written Opinion issued in corresponding International Patent Application No. PCT/US2020/038424, dated Jan. 19, 2021 (14 pages).

* cited by examiner

SAND ACCUMULATORS TO AID DOWNHOLE PUMP OPERATIONS

BACKGROUND

Hydrocarbon production wells drilled into sandstone reservoirs are typically equipped with sand control completions equipment in the form of an expandable sand screen, a gravel pack, and the like. Such sand control equipment and methods are intended to keep sand, proppant, and other particulate matter from entering the production tubing. Nevertheless, these sand control methods may not be 100% effective, and some amount of sand production is often inevitable. Artificial lift methods such as an electric submersible pump (ESP) and an electric submersible progressive cavity pump (ESPCP) installed in these wells must be designed to tolerate sand production. Subsequent references to ESPs should be understood to include any type of submersible pump unless explicitly stated otherwise.

ESPs are becoming the primary artificial lift method in many hydrocarbon fluid-producing fields. An ESP may be a complex electro-hydraulic system including a centrifugal pump, a protector and an electric motor in addition to a sensory unit and a power delivery cable. The pump may be used to lift well fluids to the surface. The motor may convert electric power to mechanical power to drive a pump via a shaft. A power delivery cable may provide a means of supplying the motor with the needed electrical power from the surface. The protector may absorb the thrust load from the pump, transmit power from the motor to the pump, equalize motor internal and external pressures, provide/receive additional motor oil as temperature changes, and prevent well fluids from entering the motor. The pump may include a number of stages, which may be made up of impellers and diffusers. The impeller, which is a rotating component, may add energy to the fluid as kinetic energy, whereas the diffuser, which is a stationary component, may convert the kinetic energy of fluids into pressure head. The pump stages may be stacked in series to form a multi-stage system that may be contained within a pump housing. The pressure head generated by each individual stage is cumulative; hence, the total pressure head developed by the multi-stage system may increase from the first to the last stage. A monitoring instrument, which may be a sub or a tool, may be installed onto the motor of the ESP to measure parameters such as pump intake and discharge pressures, intake and motor oil temperature, and vibration. Measured downhole data may be communicated to the surface via the power cable.

SUMMARY

This summary is provided to introduce a selection of concepts that are described further in the detailed description. This summary is not intended to identify key or essential features of the claimed subject matter, nor is it intended to be used as an aid in limiting the scope of the claimed subject matter.

In an embodiment, a sand accumulator includes a housing and an insert disposed inside the housing. The insert forms a continuous seal with an inner circumference of the housing. The insert includes an outer sleeve. The outer sleeve is disposed in the housing and forms an annulus between the outer sleeve and the housing. The outer sleeve includes at least one first large flow port and a first cap sealing an uphole end of the outer sleeve. The insert also includes an inner sleeve. The inner sleeve is disposed in the outer sleeve. The inner sleeve includes at least one second large flow port and a second cap sealing an uphole end of the inner sleeve. The outer sleeve and the inner sleeve are axially aligned. In a first position relative to each other, the at least one first large flow port of the outer sleeve and the at least one second large flow port of the inner sleeve are aligned in a configuration to form a first continuous flow path. In a second position relative to each other, the at least one first large flow port and the at least one second large flow port are misaligned. The aligned at least one first large flow port and the at least one second large flow port provide for a fluid flow in the annulus of the sand accumulator that is in the uphole direction and has a vortex flow.

In an embodiment, a sand accumulator for a wellbore tubular includes a housing and an insert. The housing is disposed in line with the wellbore tubular such that the housing forms a continuous seal with an outer circumference of the wellbore tubular. The insert is disposed inside the housing such that an annulus forms between the housing and the insert. The insert forms a continuous end-to-end seal with a section of the wellbore tubular that is uphole from the sand accumulator. The insert includes and inlet section and a sand settling basket. The inlet section includes at least one inlet port that is configured to permit fluid flow from the annulus to inside the inlet section. The fluid flow has an uphole component and a tangential component, which provide for the formation of a vortex flow in the inlet section. The sand settling basket has a closed downhole end and is coupled to the inlet section.

In an embodiment, a method of protecting downhole equipment in a wellbore tubular from sand entrained in a production fluid includes introducing the production fluid entrained with sand from downhole of a sand accumulator into the sand accumulator. The production fluid entrained with sand flows through an at least one radial port such that a vortex flow forms in an insert and the production fluid entrained with sand flows uphole of the sand accumulator. The sand accumulator has a housing coupled to the wellbore tubular. The insert is disposed in the housing. The insert includes at least one radial port that is configured such that when a fluid flows through the at least one radial port a vortex flow forms. The method includes ceasing the introduction of production fluid entrained with sand into the sand accumulator. The vortex flow dissipates. Sand entrained in the production fluid uphole from the sand accumulator settles into the sand accumulator. The method includes introducing the production fluid entrained with sand from downhole of the sand accumulator into the sand accumulator. The production fluid entrained with sand fluid flows through the at least one radial port. The vortex flow forms in the insert. The production fluid entrained with sand flows uphole of the sand accumulator. The accumulated sand in the sand accumulator is entrained in the vortex flow in the insert and flows uphole with the production fluid entrained with sand. The production fluid entrained with sand uphole of the sand accumulator has a greater concentration of entrained sand than the production fluid entrained with sand downhole of the sand accumulator.

Other aspects and advantages will be apparent from the following description and the appended claims.

BRIEF DESCRIPTION OF DRAWINGS

Certain embodiments of the disclosure will hereafter be described with reference to the accompanying drawings, where like reference numerals denote like elements. It should be understood, however, that the accompanying figures illustrate the various implementations described herein and are not meant to limit the scope of various technologies described herein.

Figure 1A:
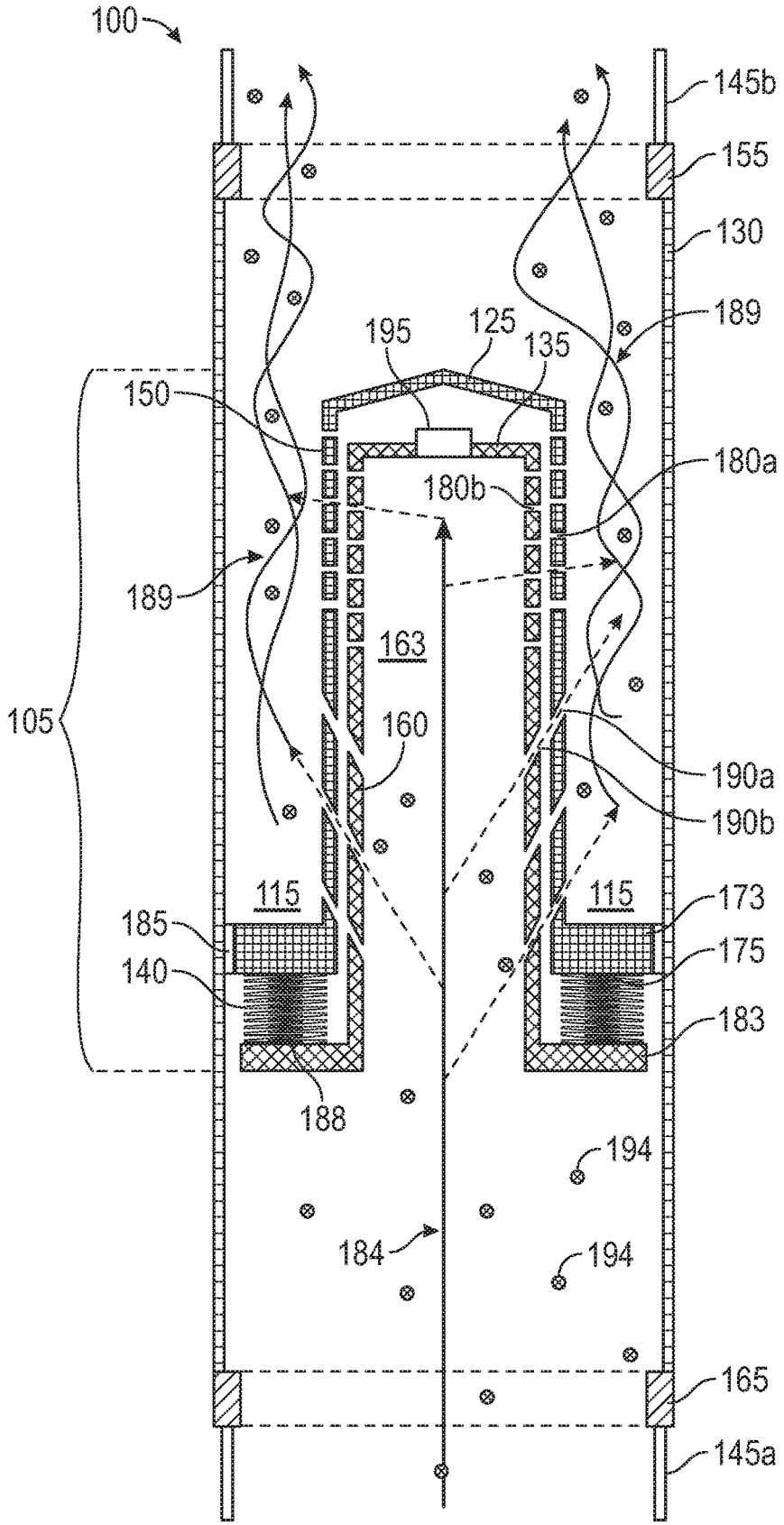
FIGS. 1A and 1B are schematic diagrams showing a section view of a sand accumulator using a double sleeve design during a production phase and during an ESP shutdown phase, respectively, according to one or more embodiments of the disclosure.

In the figures, down and downhole are toward or at the bottom and up and uphole are toward or at the top of the figure. Like numbers in similar images represent like elements. Use of a prime symbol (') indicates a like element in a different state, mode, position, or configuration than previously described; however, all other previously-provided aspects are the same.

DETAILED DESCRIPTION

The present disclosure concerns sand accumulation devices installed in line with a wellbore tubular to aid pump operations. More specifically, embodiments disclosed here are directed to a device that may be installed uphole of an artificial lift pump in a well to capture sand and prevent sand fallback into the artificial lift device.

In the case of ESPs, pump designs using an erosion resistant stage and bearing materials may be used to improve stability and reliability of the ESP. One common failure mechanism associated with ESPs during completions operations is the sand fallback and sand accumulation in the pump stages once the well is shut down or "shut in". ESP stage vanes may become plugged by the accumulated sand and prevent flow through during the dormant state or even when active. Upon ESP shutdown, sand in the production fluid may fall back downhole into the ESP, blocking discharge and upper impellers of the ESP. Upon ESP startup after shutdown, low flow can occur because of produced sand frictionally halting impeller motion of the ESP. This may cause a pump to become get stuck and be unable to rotate. It may also cause the mechanical shaft seal may get damaged and start leaking. Low flow may result in the pump motor heating up, loading up, and damage.

In this disclosure, "sand" is defined as fine, solid particulate matter from a subterranean formation, especially formations that include sandstones. Production fluids may include entrained solids, including sand and compositions that include sand, such as artificial sand compositions, including proppants. The sand may originate from a subterranean formation, such as a sandstone formation.

"Up" and "down" are generally oriented relative to a local vertical direction. However, "uphole" and "downhole" in the oil and gas industry may more generally refer to directed toward or away from the earth's surface, respectively, within the confines of a wellbore. For example, if one was to move uphole in a horizontally-oriented wellbore, the true depth versus a vertical plane may change significantly, slightly, or not at all although the movement is "uphole" simply due to wellbore orientation. In the accompanying drawings for the sake of simplicity, uphole and downhole, and up and down, use the convention of the top of the figure is up and uphole and the bottom of the figure is down and downhole. It should be understood by one of ordinary skill in the art that the systems and apparatuses, and the methods in which they are used, may be oriented to be uphole/downhole but not up/down.

It should be noted that fluids may be generally described as flowing uphole or downhole, or "upstream" or "downstream" when the fluids do so in bulk. It is noted that local variations in fluid flow direction because of nearby structure or obstacles may alter localized flow.

A wellbore tubular in this disclosure includes any type of oilfield pipe. Wellbore tubular may include, but are not limited to, drill pipe, drill collars, casing, coiled tubing, and production tubing.

Figure 1B:
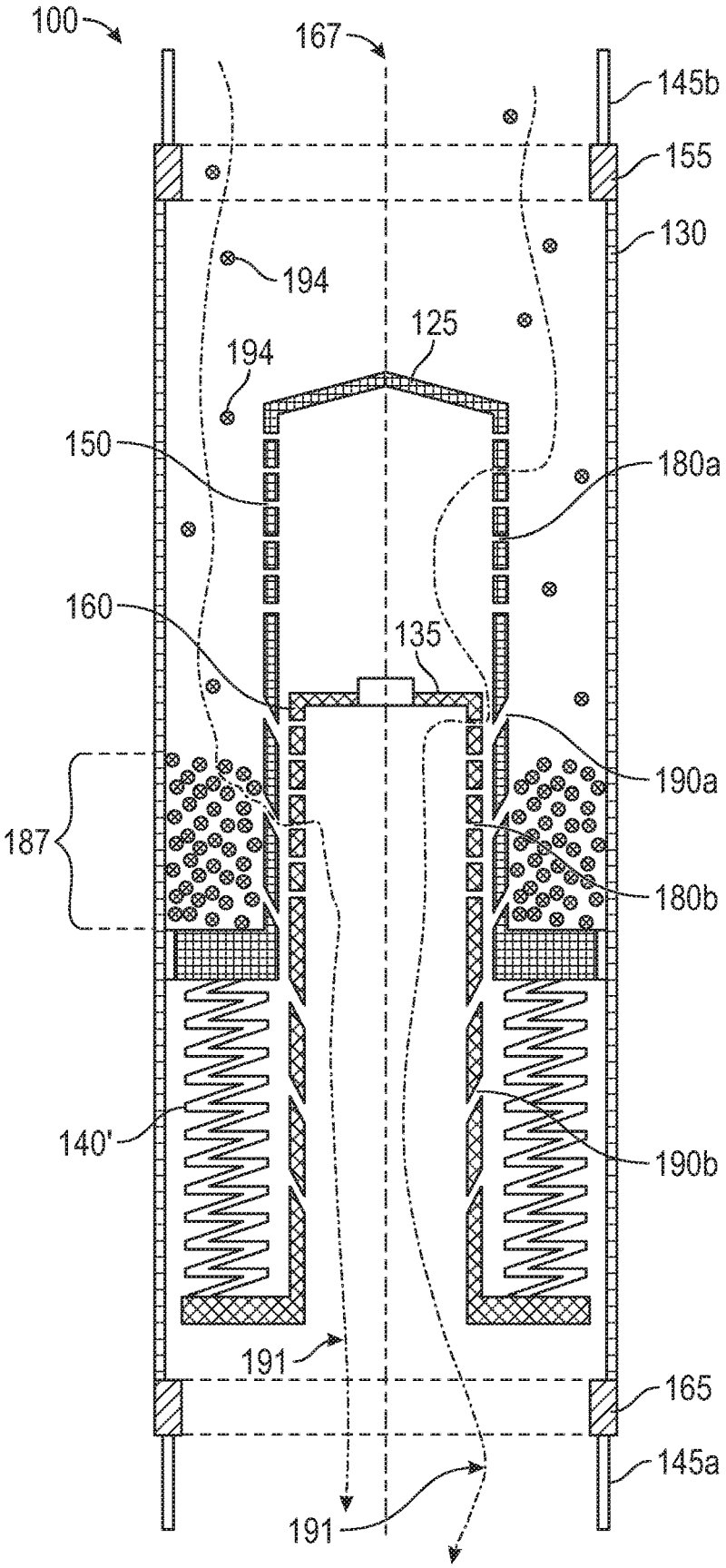

FIGS. 1A and 1B depict schematic diagrams showing section views of a sand accumulator 100 using a double sleeve design during a production phase and during an ESP shutdown phase, respectively, according to one or more embodiments of the disclosure. The sand accumulator 100 may be used during completions or production operations to protect artificial lift pumps, such as ESPs, and other downhole devices from sand and other particulates entrained in the production fluid.

As shown in FIGS. 1A and 1B, sand accumulator 100 may be disposed in line with a wellbore tubular 145 (shown as 145*a* and 145*b*). In other words, the sand accumulator 100 may be coupled between segments of wellbore tubular 145. In FIG. 1A, fluids may flow (arrows 184, 189) during a production phase from the downhole wellbore tubular 145*a*, through the sand accumulator 100, and into the uphole wellbore tubular 145*b*. These produced fluids may entrain sand or other solids 194. In one or more embodiments, equipment other than wellbore tubulars 145*a*, 145*b* may be located directly uphole or downhole from, respectively, the sand accumulator 100, provided the equipment is configured to allow fluid flow. In some embodiments, an ESP (not shown) may be coupled downhole of the sand accumulator 100, including in place of the downhole wellbore tubular 145*a*.

As shown, the sand accumulator 100 may include a housing 130 that is configured to connect between segments of wellbore tubulars 145*a*, 145*b*; between a segment of either wellbore tubulars 145*a* and a downhole tool (not shown), or between two downhole tools (not shown). In other words, the sand accumulator 100 may be assembled in line with the wellbore tubulars 145*a*, 145*b*. The housing 130 of the sand accumulator 100 includes a base 165 that may couple to downhole wellbore tubular 145*a* or other equipment located immediately downhole of the sand accumulator 100, for example, an ESP. The housing 130 of the sand accumulator 100 may also include a head 155 that may couple with the uphole wellbore tubular 145*b* or other equipment uphole of the sand accumulator 100.

The sand accumulator 100 includes various components disposed inside housing 130. These components disposed inside housing 130 is collectively referred to as an insert 105. The insert 105 forms a continuous seal 185 with an inner circumference of the housing 130. The seal 185 may be impermeable to at least downhole fluids, including liquids and gases. The seal 185 may be a metal-to-metal seal, or may include an elastomeric O-ring, or a single-use gasket, or some other material or combination of materials that ensure the integrity of the seal 185. The insert 105 may include an outer sleeve 150 and an inner sleeve 160 disposed within the outer sleeve 150. The outer sleeve 150 and the inner sleeve 160 as shown in FIGS. 1A and 1B are generally cylindrical (that is, a hollow cylinder) in shape; however, in some other embodiments, the outer sleeve 150 and inner sleeve 160 may have other forms, for example, a hollow rectangular or hexagonal prism, or other shapes, including irregular or non-traditional geometric shapes.

As shown, the inner sleeve 160 is concentrically disposed within the outer sleeve 150. Thus, the outer diameter of inner sleeve 160 is less than an inner diameter of the outer sleeve 150. The outer sleeve 150 is configured such that when the insert 105 is disposed in the housing 130, an annulus 115 is formed between the housing 130 and the outer sleeve 150. Therefore, as shown, the outer diameter of the outer sleeve 150 of the insert 105 is smaller than the inside diameter of the housing 130. In one or more embodiments, the insert 105 is coaxially aligned within the housing 130, which are both aligned with the flow axis 167.

The outer sleeve 150 may include at least one first large flow port 190*a*, at least one first small flow port 180*a*, or both. The at least one first small flow port 180*a* may be disposed in a portion along the outer sleeve 150 that is different from the portion that includes the at least one first large flow port 190*a*. For example, as shown, the at least one first small flow port 180*a* may be located axially above or uphole from the at least one first large flow port 190*a*. In one or more embodiments, the at least one first large flow port may include a plurality of large flow ports disposed azimuthally around the outer sleeve 150. In one or more embodiments, the at least one first small flow port may include a plurality of small flow ports disposed azimuthally around the outer sleeve 150. Further, one of ordinary skill in the art will appreciate that the terms "small" and "large" indicate a relative size difference between the various ports, such that the outer sleeve 150 includes at least one port (that is, the at least one first small flow port 180*a*) smaller than at least one other port (that is, the at least one first large flow port 190*a*). The flow ports may be configured as small openings extending from an inner surface of the outer sleeve 150 to an outer surface of the outer sleeve 150, and therefore may provide fluid communication from within the outer sleeve 150 to annulus 115 or and vice versa. The ports may have a circular, oval, square, rectangular, triangular, quadrilateral, other geometric cross section, or an irregular cross section.

The outer sleeve 150 may also include a first cap 125 positioned at a first end, such as an uphole end, of the outer sleeve 150 that seals impermeably an uphole end of the outer sleeve 150 (that is, the uphole end of outer sleeve 150 is sealed). In one embodiment, the first cap 125 may be a separate component coupled to the outer sleeve 150 by, for example, mechanical fasteners or welding, or by other methods known in the art. In other embodiments, the first cap 125 may be integrally formed with the outer sleeve 150. In one or more embodiments, the first cap 125 may be tapered towards the uphole direction. In other words, the first cap 125 may be formed such that a peak is provided in the cap 125 in the uphole direction. The peak may serve to move settling sand 187 into annulus 115 when, for example, the ESP is shut down, uphole fluid flow ceases production fluids fall back 191 through sand accumulator 100.

The outer sleeve 150 also includes a second end (downhole end). The second end of the outer sleeve 150 may include a flange 173 that extends radially to an inner circumference of the housing 130, forming the impermeable seal described previously between the flange 173 (and, thus, outer sleeve 150) and housing 130.

In one or more embodiments, a region of the outer sleeve 150 that includes the at least one first small flow port 180*a* may be disposed uphole from a region of the outer sleeve 150 that includes the at least one first large flow port 190*a*.

In the absence of uphole flow, the sand accumulator 100 may accumulate sand and other solids in the annulus 115 between the housing 130 and the outer sleeve 150, including on the flange 173 of the outer sleeve 150.

The inner sleeve 160 may be disposed concentrically within the outer sleeve 150 and may be movable with respect to the outer sleeve 150 along the flow axis 167 of sand accumulator 100. The inner sleeve may include at least one second large flow port 190*b*, at least one second small flow port 180*b*, or both. The at least one second small flow port 180*b* may be disposed in a portion along the inner sleeve 160 that is different from the portion that includes the at least one second large flow port 190*b*. For example, as shown, the at least one second small flow port 180*b* may be located along the flow axis 167 uphole from the at least one second large flow port 190*b*. In one or more embodiments, the at least one second large flow port may include a plurality of large flow ports disposed azimuthally around the inner sleeve 160. In one or more embodiments, the at least one second small flow port may include a plurality of small flow ports disposed azimuthally around the inner sleeve 160. Further, one of ordinary skill in the art will appreciate that the terms "small" and "large" is similar to the relationship previously described for these series of ports (180*b*, 190*b*). The flow ports may be configured as small openings extending from an inner surface of the inner sleeve 160 to an outer surface of the inner sleeve 160, and therefore may provide fluid communication from the inner cavity 163 of the inner sleeve 160 to the exterior of the inner sleeve 160 and vice versa. The ports may have a circular, oval, square, rectangular, triangular, quadrilateral, other geometric cross section, or an irregular cross section.

The at least one second large flow port 190*b* of the inner sleeve 160 and the at least one first large flow port 190*a* of the outer sleeve 150 may have the same cross section. In some embodiments, the at least one second small flow port 180*b* of the inner sleeve 160 and the at least one first small flow port 180*a* of the outer sleeve 150 may have the same cross section.

The inner sleeve 160 may also include a second cap 135 positioned at a first end, such as an uphole end, of the inner sleeve 160 that seals impermeably an uphole end of the inner sleeve 160 (that is, the uphole end of inner sleeve 160 is sealed). In one embodiment, the second cap 135 may be a separate component coupled to the inner sleeve 160 by, for example, mechanical fasteners or welding, or by other methods known in the art. In other embodiments, the second cap 135 may be integrally formed with the inner sleeve 160.

The second cap 135 at the uphole end of the inner sleeve 160 may optionally include a rupture disk 195. The rupture disk 195 may be used to enhance well control. In the event that too much sand accumulates in the sand accumulator 100, and fluid communication with the well below the sand accumulator 100 is lost, the rupture disk 195 may be broken by pressuring up the wellbore tubular 145*b*. Kill fluids may be bullheaded down the wellbore through sand accumulator 100 to kill the well and regain well control.

The inner sleeve 160 has a second, or downhole, end that may extend downhole beyond a second or downhole end of the outer sleeve 150. The second end of the inner sleeve may include a flange 183 that, in some embodiments, does not contact the housing 130. In other words, an outer diameter of the flange 183 may be less than an inner diameter of the housing 130. In one or more embodiments, the outer diameter of the flange 183 is greater than the outer diameter of the outer sleeve 150 but less than the outer diameter of the flange 173.

The sand accumulator 100 may include a means of providing a restoring force between the inner sleeve 160 and the outer sleeve 150. This means provides a force for moving the inner sleeve 160 along the flow axis 167 with respect to the outer sleeve 150. Such means may include a spring, a combination of magnets, including electromagnets or permanent magnets, or other magnetic forces, or electrical forces due to electrically charged bodies.

In the embodiment shown in FIG. 1A, the insert 105 includes a spring 140 disposed between a downhole surface 175 of flange 173 and an uphole surface 188 of flange 183. The spring 140 of FIG. 1A allows movement of the inner sleeve 160 along the flow axis 167 with respect to a stationary outer sleeve 150 as extended spring 140' as seen in FIG. 1B. Such movement of the inner sleeve 160 with respect to the outer sleeve 150 provides alignment or misalignment of the ports of the inner and outer sleeves 150, 160, as will be discussed. Briefly, as shown in FIG. 1A, compression of the spring 140 due to a force, such as a fluid force acting from downhole the insert 105, moves the inner sleeve 160 uphole further into the outer sleeve 150. When a force acting downhole the insert 105, such as a fluid force, is decreased or removed, the restoring force of the spring 140 increases and the extended spring 140' forms. Upon extension, the separation between flange 173 and flange 183 increases by moving the inner sleeve 160 downhole, and in some embodiments, at least partially out of the outer sleeve 150.

Each large flow port 190*a*, 190*b* may include a helical orientation that may provide fluid flow in the uphole direction with a vortex flow 189 in the annulus 115. Helical orientation of flow ports and fluid flow refers to a vector direction with a component in either an uphole or a downhole direction, a component in a radial direction, and a tangential component. In other words, with a helical orientation, the large flow ports 190*a*, 190*b* are angled, for example, upward (that is uphole) as well as deviated from the central axis of the insert 105 or housing 130 (see, for example, FIG. 3B). This orientation allows the flow to create a vortex action in the annulus 115. A vortex flow 189 in the annulus 115 during production of fluids may provide energy to remove settled sand 187 from the annulus 115 that may have accumulated in the annulus 115 during an ESP shutdown phase.

In some embodiment, such as shown in FIGS. 1A and 1B, the large flow ports 190*a*, 190*b* may be angled upward (that is, uphole) and also deviated, in other words angled, from a central axis of the insert 105 or housing 130. This orientation allows the flow to create vortex action in the annulus 115 between outer sleeve 150 and the tool housing 130, facilitating the clean-up of accumulated sand.

During production of a well, the sand accumulator 100 may be positioned in a first position, as shown in FIG. 1A. In the first position, the at least one second large flow port 190*b* may form at least one first continuous flow paths with the at least one first large flow port 190*a* as fluid flows 184 in an uphole direction. Fluid flows 184 in the uphole direction through the wellbore tubular 145*a*, enters the sand accumulator 100 through base 165 and into an inner cavity 163 formed by the inner sleeve 160 of the insert 105. Fluid then flows through aligned large flow ports 190*a*, 190*b* and aligned small flow ports 180*a*, 180*b* into the annulus 115 formed between the housing 130 and the outer sleeve 150 of the insert (dashed arrows of FIG. 1A; arrows are dashed for ease of viewing; not all flow paths are indicated for the sake of clarity). Vortex flow 189 flow continues uphole through the head 155 of the sand accumulator 100 and into the wellbore tubular 145*b*.

When fluid is not being produced, such as when an ESP is shutdown as illustrated in FIG. 1B, the sand accumulator 100 may be positioned in a second position. In the second position, that is, in the absence of uphole fluid flow, flow paths from inner cavity 163 of inner sleeve 160 to the annulus 115 outside the outer sleeve 150, are fluidly blocked. By moving the inner sleeve 160 relative to the outer sleeve 150, in some embodiments, fluid communications between the annulus 115 and the inner cavity 163 are greatly reduced. Specifically, the inner sleeve 160 may be moved relative to the outer sleeve 150 to move the at least one second large flow port 190*b* of inner sleeve 160 out of alignment with the at least one first large flow port 190*a* of the outer sleeve 150. When the first and second large ports 190*a* and 190*b* are out of alignment, fluid communication in some embodiments from the inner cavity 163 to annulus 15 is eliminated.

In some other embodiments, in the second position, the region of the at least one second small flow port 180*b* of the inner sleeve 160 may be radially adjacent to the region of the at least one first large flow port 190*a* of the outer sleeve 150, such as shown in FIG. 1B. In this position, the flow paths from inner cavity 163 to annulus 115 may only be partially blocked. This partial blockage may depend on the orientation and relative position of the at least one second small flow port 180*b* and the at least one first large flow port 190*a*. As well, particulate matter and sand 194, such as settling sand 187, may partially or completely block fluid flowing 191 from the annulus 115 to the inner cavity 163. The sand 194 and particulate matter may settle in the annulus 115 uphole of flange 173 of the outer sleeve 150, as shown in FIG. 1B. The fluids may continue drain back into the well through these ports 180, 190 (see dot-dashed arrows 191).

In one or more embodiments, the at least one first, the at least one second small flow port, or both, may be a sand screen similar in structure to those previously described. A sand screen may be formed of a wire mesh that is wrapped and welded in place on a portion of a sleeve, such as the inner sleeve 160. The sand screen slots may be small enough to exclude larger sand grain sizes while allowing finer sand grains to pass through the sand screen.

Referring to FIGS. 1A and 1B together, the operation of the accumulator 100 will now be described. When the ESP is on, the force of the flow of fluid flowing uphole 184 acting on the downhole-facing portion of inner sleeve 160 is greater than the restoring force of the spring 140. Therefore, the inner sleeve 160 may be pushed uphole by the force of fluid. As the inner sleeve 160 is moved uphole further into the outer sleeve 150, the at least one second large flow port 190*b* of the inner sleeve 160 is aligned with the at least one first large flow port 190*a* of the outer sleeve 150, thereby allowing fluid flow 184 through sand accumulator 100 and vortex flow 189 to form. Sand particles 194, small and large, are produced and carried uphole with the produced fluid.

During ESP shutdown (that is, when fluid is not being pumped uphole), the inner sleeve 160 may be urged downward by the restoring force of the extended spring 140', thereby moving the inner sleeve 160 downhole with respect to the outer sleeve 150. Movement of the inner sleeve 160 downhole moves the at least one second large port 190*b* on the inner sleeve 160 out of alignment with the at least one first large port 190*a* of the outer sleeve 190*a*. In some embodiments, movement of the inner sleeve 160 downhole also moves the at least one second small port 180*b* on the inner sleeve 160 to a position wherein the at least one second small port 180*b* on the inner sleeve 160 axially align with the at least one first large port 190*a* on the outer sleeve 150. This configuration of the ports 180*b* and 190*a* reduces or prevents sand or particulate matter from flowing back through the insert and down toward the ESP. Sands falling back will be captured and accumulated in the annulus 115 between the outer sleeve 150 and tool housing 130.

As shown in FIGS. 1A and 1B, the spring 140 may compress during production of downhole fluids to allow fluid to flow uphole through the sand accumulator 100. However, when the force of the produced fluid is removed (that is, when the ESP is shut down and fluid production stops), the restoring force of the extended spring 140' moves the inner sleeve 160 relative to the outer sleeve 150. In one or more embodiments, the inner sleeve 160 moves axially downhole along the flow axis 167 and out of the outer sleeve 150. As the inner sleeve 160 moves relative to outer sleeve 150, flow paths from inside the sleeve to outside the sleeve and from outside the sleeve to inside the sleeve partially close due to misalignment of the large flow ports 190*a*, 190*b* that were aligned when the inner sleeve 160 was positioned within the outer sleeve 150. Similarly, as the inner sleeve 160 moves relative to outer sleeve 150, flow paths partially close due to misalignment of small flow ports 180*a*, 180*b* that were aligned when the inner sleeve 160 was positioned within the outer sleeve 150. With fluid production stopped and the extended spring 140' in a relaxed position, sand 194 entrained in the produced fluid uphole of the sand accumulator 100 may drift downhole and form settled sand 187 in the annulus 115 between the hosing 130 and the outer sleeve 150, including flange 173. As discussed previously, in some embodiments, when the inner sleeve 160 is moved out of the outer sleeve 150, the at least one second small flow port 180*b* of the inner sleeve 160 may align with the at least one first large flow port 190*a* of the outer sleeve 159. Settled sand 187 is prevented from flowing back to the ESP or other equipment downhole from the sand accumulator 100 because the flow paths are blocked by the movement of inner sleeve 160 with respect to outer sleeve 150. The relative motion interrupts large flow port flow paths and small flow port flow paths; however, in some instances latent fluid flow paths remain in sand accumulator 100, as shown by fluid flow 191, which may facilitate the accumulation of sand. In one or more embodiments, the large flow path of the at least one first large flow port 190*a* of outer sleeve 150 is interrupted by the at least one second small flow port 180*b* of inner sleeve 160.

FIGS. 2A-2D show another embodiment of a sand accumulator 200 where all components are fixed with respect to each other. This embodiment may be used in the same environments as those of sand accumulator 100, previously described. The sand accumulator 200 may be used during completions or production operations to protect artificial lift pumps, such as ESPs, and other downhole devices from sand and other particulates entrained in the production fluid or fluids. Referring now to FIGS. 2A-2D, in one or more embodiments, the sand accumulator 200 may be disposed in line with wellbore tubular 225. In other words, the sand accumulator 200 may be coupled between segments of wellbore tubular 225, such as downhole wellbore tubular 225*a* and uphole wellbore tubular 225*b*.

Figure 2A:
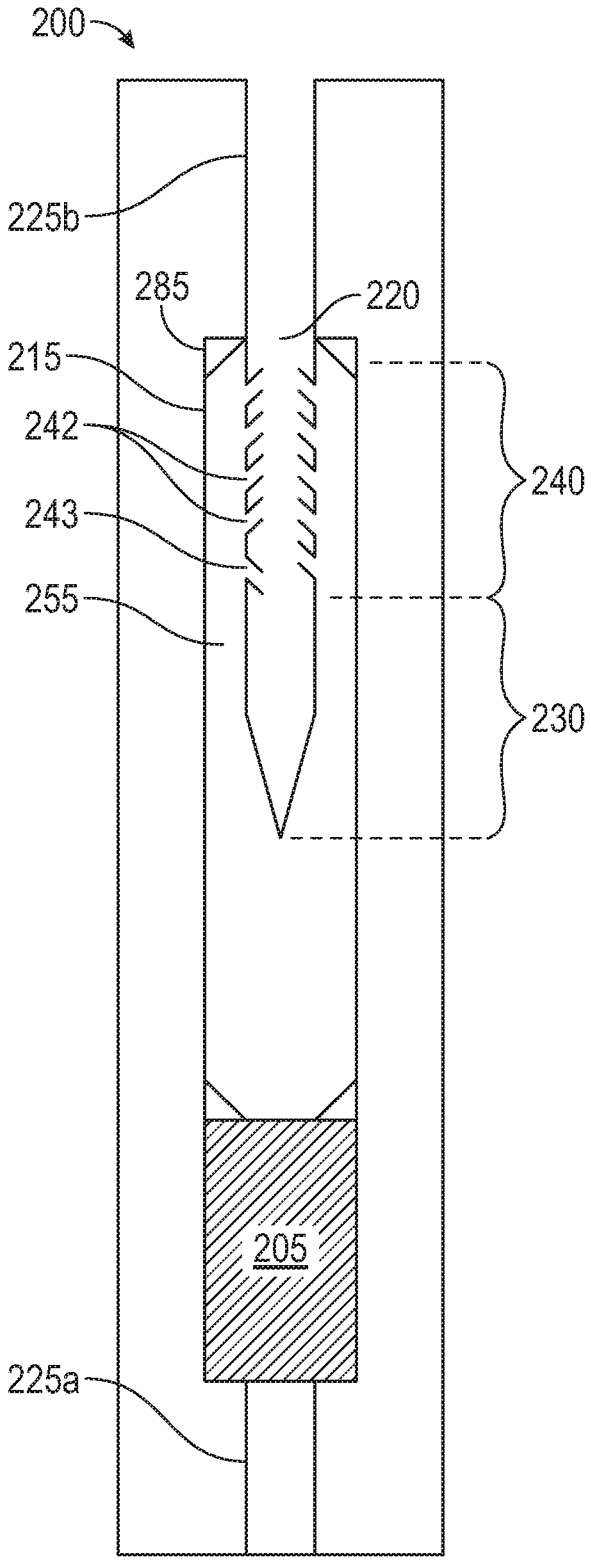
FIGS. 2A-2D are schematic diagrams showing a section view of a sand accumulator illustrating accumulator setup, open flow, shut in, and sand offloading, respectively, according to one or more embodiments of the disclosure.
Figure 2B:
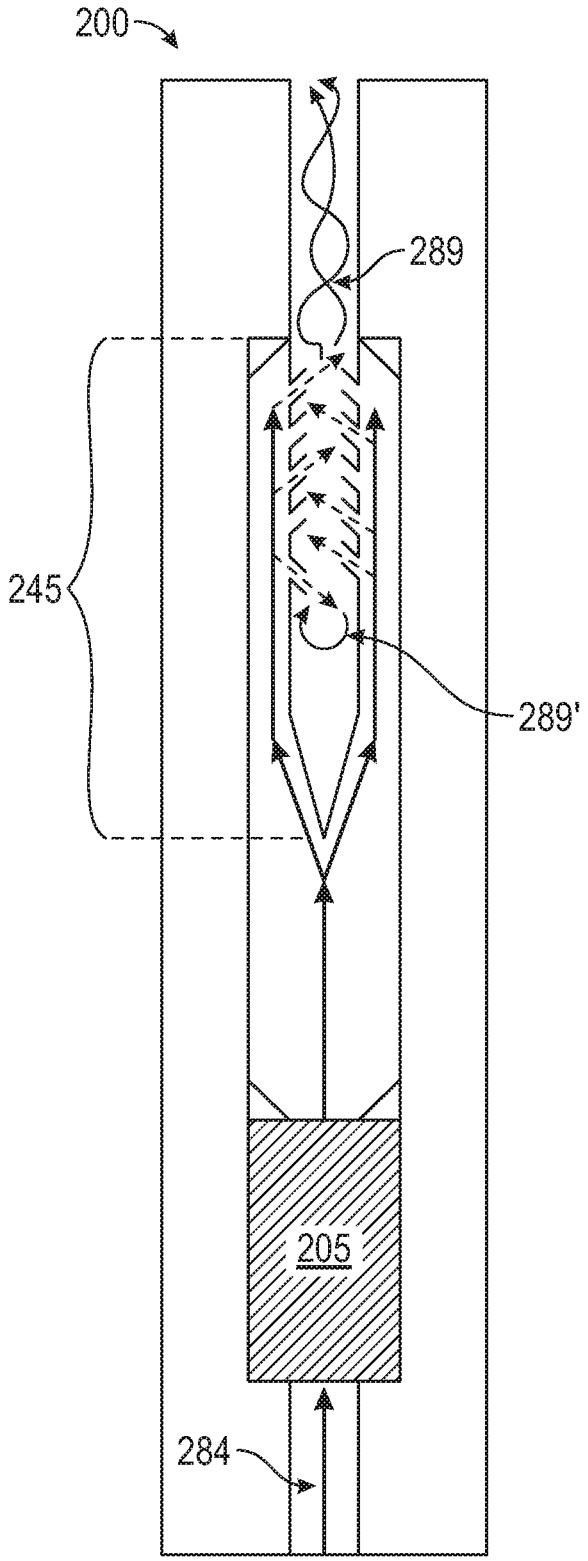
Figure 2C:
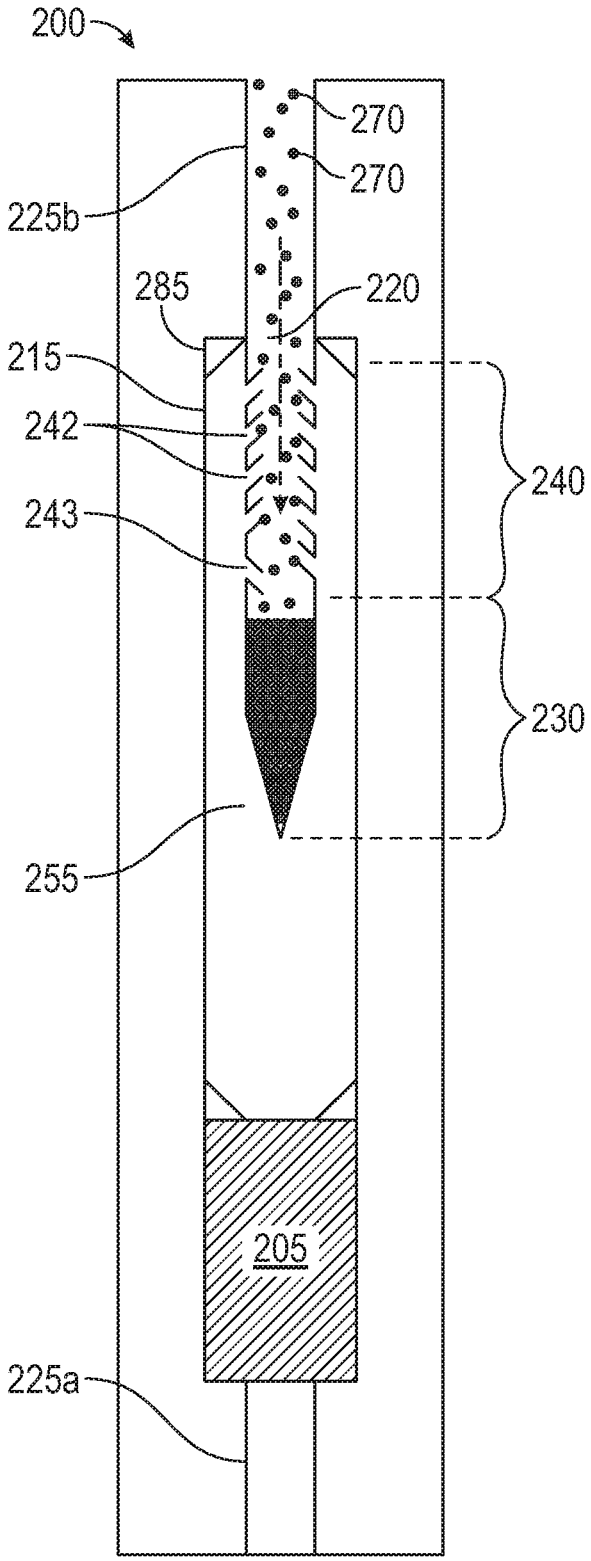

As shown in FIG. 2B, production fluid flow (arrow 284) may flow during a production phase from the downhole wellbore tubular 225*a*, through the sand accumulator 200, and into the uphole wellbore tubular 225*b* (as a vortex flow; arrow 289). The produced fluids may entrain sand and particulate matter 270 as they flow through the apparatus as shown in FIG. 2C. In one or more embodiments, equipment other than wellbore tubulars 225*a*, 225*b*, may be coupled uphole or downhole from the sand accumulator 200, provided the equipment is capable of permitting fluid flow, such as fluid flow 289. In one or more embodiments, an ESP 205 may be coupled downhole of the sand accumulator 200 uphole of the downhole wellbore tubular 225*a*, as shown in the various FIG. 2.

As shown in FIG. 2A, the sand accumulator 200 may include a housing 215 that is configured to connect between segments of wellbore tubulars 225*a*, 225*b*; between a segment of wellbore tubular 225*b* and a downhole tool (for example, ESP 205); or between two downhole tools (not shown). In other words, the sand accumulator 200 may be assembled in line with the wellbore tubular 225*a*, 225*b*. Referring now to FIGS. 2A-2D, in one or more embodiments, the sand accumulator 200 may include a housing 215 disposed in line with the wellbore tubular 225*b*. In some embodiments, a housing 215 may form a continuous end-to-end seal 285 with an outer circumference of the wellbore tubular 225*b*.

Embodiments of the sand accumulator includes those parts of the sand accumulator 200 disposed inside housing 215. These parts disposed inside housing 215 will be collectively referred to as an insert 245. An insert 245 forms a continuous end-to-end seal 285 with a section of the wellbore tubular 225*b* that is uphole from the sand accumulator 200. The continuous end-to-end seal 285 may be a metal-to-metal seal, or may include an elastomeric O-ring, or a single-use gasket, or some other material or combination of materials that ensure the integrity of the continuous end-to-end seal 285. The insert 245 may be generally cylindrical (that is, hollow cylinder) in shape. As shown, the outer diameter of insert 245 is smaller than the inside diameter of the housing 215. In one or more embodiments, the insert 245 is coaxially aligned within the housing 215. An annulus 255 may be formed between the housing 215 and the insert 245. The annulus 255 may receive production fluid flow (arrow 284) from a downhole end of the sand accumulator 200.

In one or more embodiments, the insert 245 is a hollow cylindrical body having a first end and a second end. In one or more embodiments, the first end, an uphole end, is open, while the second end, the downhole end, is closed. The open first end of the insert 245 is in fluid communication with the wellbore tubular 225*b* that is uphole from the sand accumulator 200. In some embodiments, the open end of the insert 245 may be an outlet 220 of the sand accumulator 200.

The first end of the insert 245 defines an inlet section 240 adjacent to the uphole section 225*b* of the wellbore tubular 225. The inlet section 240 may include at least one inlet port 242 that permits fluid to flow from the annulus 255 to inside the uphole section 225*b* of the wellbore tubular 225. The second end of the insert 245 defines a sand-settling basket 230 that may accumulate sand and particulate matter 270 entrained in the produced fluids when the ESP 205 is shut down.

In FIG. 2B, production fluid flow (arrow 284) moves from downhole in an uphole direction through wellbore tubular 225*a* and through ESP 205. Produced fluids pumped by the ESP then flow through the annulus 255 formed by the sand accumulator 200 between housing 215 and insert 245. Produced fluid flows traversing from the annulus 255 through the at least one inlet port 242 in inlet section 240 of insert 245 (see dashed arrows; not all arrows shown for clarity), creating a vortex flow 289 as the produced fluid then proceeds uphole through outlet 220 into wellbore tubular 225*b*.

The sand-settling basket 230 of the insert 245 may include an uphole end adjacent to and in fluid communication with the inlet section 240 of the insert 245 and a closed downhole end. The closed downhole end of the sand settling basket 230 may have a tapered shape in the downward direction, such as shown in FIG. 2; however, such tapering or configuration is not required. In one or more embodiments, the tapered shape may be conical in shape. When fluid production has been halted, sand and particulate matter 270 entrained in the production fluid that had been pumped uphole of the sand accumulator 200 may settle as accumulated sand and particulate matter 270 in the sand settling basket 230 as shown in FIG. 2C.

When fluid production is resumed after a shut-in period, production fluid flows (arrows 284) uphole in annulus 255, passes through the at least one inlet port 242 in the inlet section 240 to the inner volume of the insert 245 in a manner that produces vortex flow 289. See FIG. 2D.

Figure 2D:
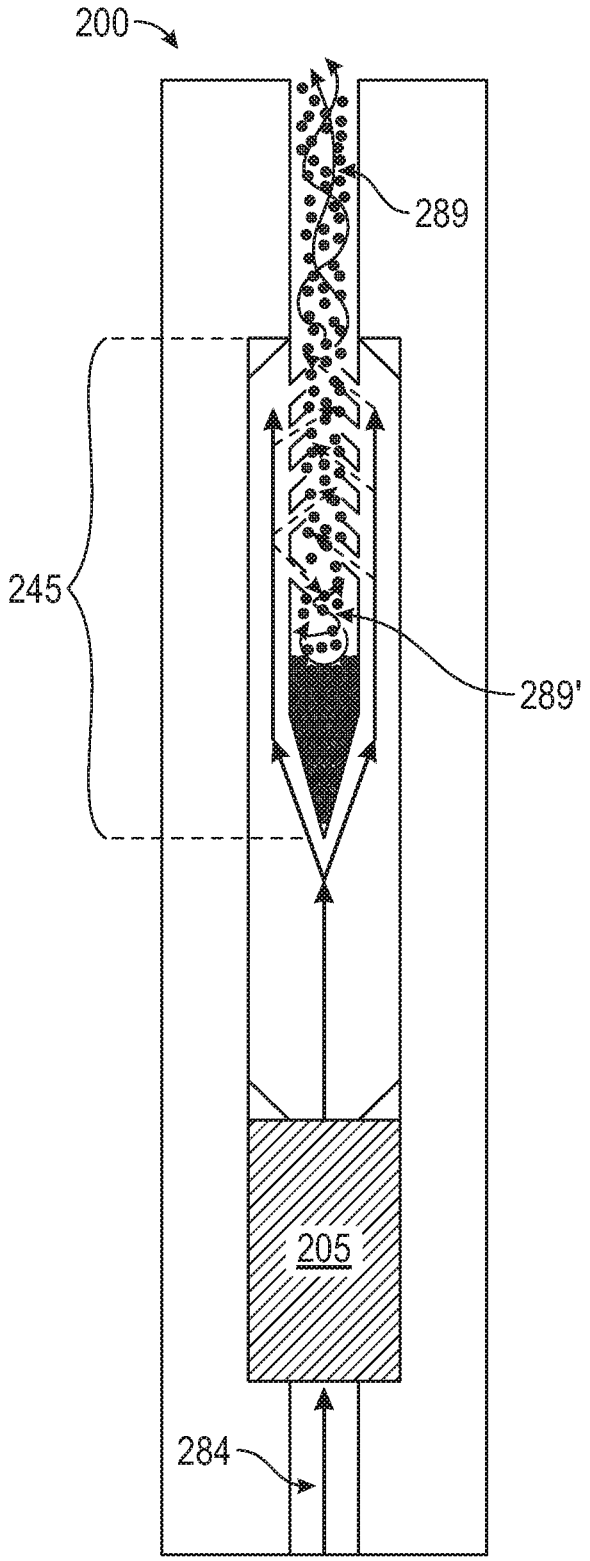

The at least one inlet port 242 of the inlet section 240, such as port 243 of FIGS. 2A-D, may be oriented such that flow from the annulus 255 into the insert 245 includes a downhole flow component (that is, opposite to the direction of overall uphole flow direction during a production phase) and a tangential component. This combination of downhole and tangential may result in second vortex flow 289' occurring inside the insert 245 in the sand settling basket 230 (The orientation of the at least one inlet ports 242, 243 is further described with respect to FIGS. 3A and 3B.). The vortex flow 289' may entrain the sand and particulate matter 270 that has aggregated in the sand settling basket 230. The sand and particulate matter 270, now fluidized with the production fluid flow and in the second vortex flow 289' and eventually vortex flow 289, moves in a generally uphole direction as shown in FIG. 2D.

When the well is shut in and the ESP is not operating, sand and particulate matter 270 in the fluid uphole of the sand accumulator 200 may accumulate in the sand settling basket 230 as shown in FIG. 2C. When production fluids are being produced again, the sand and particulate matter 270 that accumulated in the sand-settling basket 230 may be off-loaded (that is, removed) from the sand accumulator 200 due to the second vortex flow 289' and then carried out the produced fluid uphole through outlet 220 and wellbore tubular 225*b* through vortex flow 289 that is disposed uphole of sand accumulator 200, as shown in FIG. 2D. This sand and particulate matter 270 may be removed at controllable rates. These rates may be controlled by controlling the rate at which fluids are produced from the well.

In one or more embodiments, for example, an embodiment like that shown in FIGS. 2A and 2B, an accumulator 200 may have no moving parts, may be rugged, and may have reasonable space requirements. The overall outer diameter of the housing 215 will be affected by the need to fit inside the completion casing inside diameter. Within housing 215, the annulus 255 size and the settling basket 230 size may be designed to accommodate the required production rates and the volume of sand to be captured. Similarly, one or more embodiments may aim to use fluid vortices, such as second vortex flow 289', produced by the flow patterns created by the at least one inlet port 243 of inlet section 240, in an effort to fluidize and transport sand particles stored intentionally downhole of the second vortex flow 289' in the sand settling basket 230 when flow is stopped. When the production fluid flow (arrow 284) is reestablished, the aggregated sand particles in sand settling basket 230 are controllably carried with the vortex flow 289 out of the system. The device may be installed uphole of artificial lift equipment, for example, an ESP 205, in order to protect the systems downhole from it. Depth of the sand settling basket 230 may be determined at least partially by the sand content per barrel and the column height uphole of the sand accumulator 200.

Figure 3A:
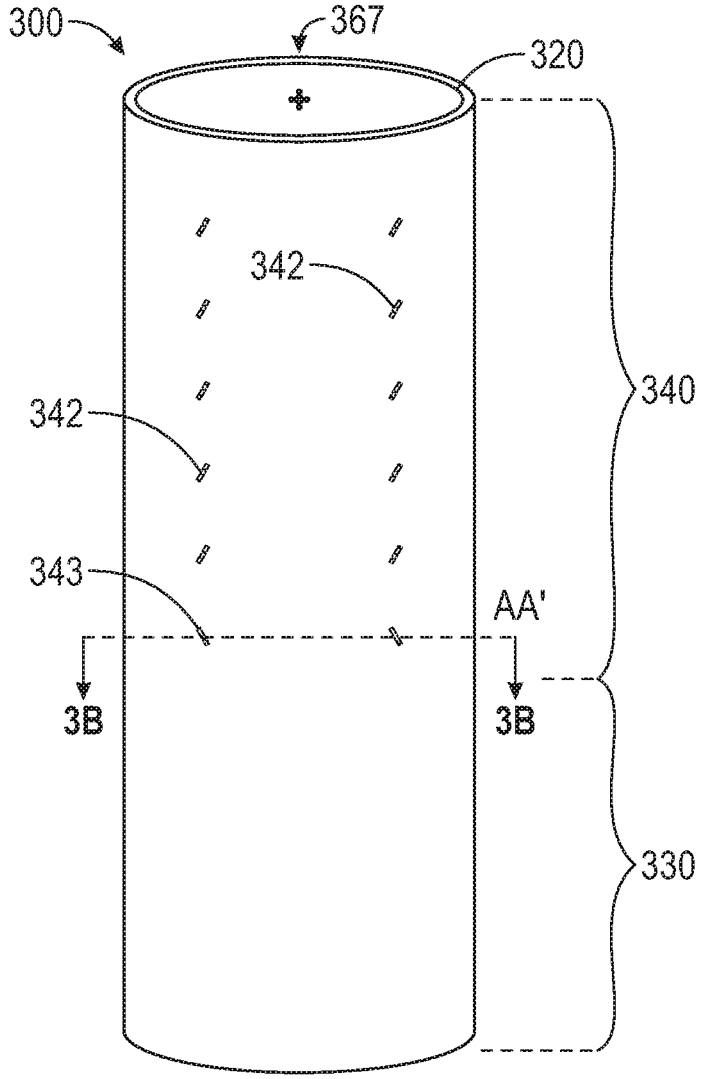
FIG. 3A is a schematic diagram showing a perspective view of an inlet section of a sand accumulator according to one or more embodiments of the disclosure.

FIG. 3A illustrates the relative orientation of the at least one inlet ports 342, 343 as seen in a perspective view of an inlet section 340 and sand settling basket 330 of a sand accumulator 300. Sand accumulator 300 is of a similar configuration as the sand accumulator 200 of the embodiment shown in FIGS. 2A-2D according to one or more embodiments. In the figure, eleven inlet ports 342 and one inlet port 343 are visible in inlet section 340. Each of the inlet ports 342, 343 imparts a velocity to the fluid as it passes through the inlet port such that the produced fluid is directed away from the geometric center 367 of the inlet section 340. Inlet ports 342 are directed in a generally uphole direction whereas inlet port 343 is directed in a generally downhole direction.

Figure 3B:
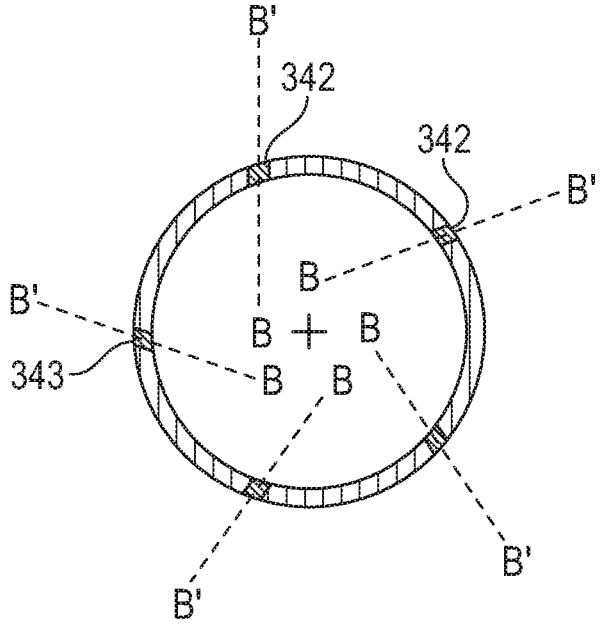
FIG. 3B is a schematic diagram showing the AA' cross-section view of the inlet section of a sand accumulator according to one or more embodiments of the disclosure.

Sand accumulator 300 is shown with a cross-section AA' across an inlet port 342 and 343. FIG. 3B is a schematic diagram showing a cross section view of an inlet section 340 of a sand accumulator 300. The at least one inlet ports 342, 343, which conducts fluid from outside of the inlet section 340 to inside of the inlet section 340, may be configured so that the production fluid passing through the at least one inlet ports 342, 343 flows in a direction other than toward the geometric center 367 of a cross-section of the inlet section 340 (see dashed lines BB' versus geometric center 367). In addition, as described previously, fluid passing through the at least one inlet port 342, 343 is also given a velocity component through the cross-sectional plane of FIG. 3B in an upward, or uphole, direction, such as inlet port 342, and downward, or downhole, direction, such as inlet port 343. The flow direction imparted by the orientation of the at least one inlet port 342, 343 thereby induces cyclonic or vortex flow.

The following is directed to various exemplary embodiments of the disclosure. Although one or more of these embodiments may be preferred, the embodiments disclosed should not be interpreted, or otherwise used, as limiting the scope of the disclosure, including the claims. In addition, those having ordinary skill in the art will appreciate that the following description has broad application, and the discussion of any embodiment is meant only to be exemplary of that embodiment, and not intended to suggest that the scope of the disclosure, including the claims, is limited to that embodiment.

The particulars shown here are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, the description taken with the drawings making apparent to those skilled in the art how the several forms of the present disclosure may be embodied in practice. Further, like reference numbers and designations in the various drawings indicate like elements.

Certain terms are used throughout the following description and claims to refer to particular features or components. As those having ordinary skill in the art will appreciate, different persons may refer to the same feature or component by different names. This document does not intend to distinguish between components or features that differ in name but not function. The figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first component is coupled to a second component, that connection may be through a direct connection, or through an indirect connection via other components, devices, and connections. Further, the terms "axial" and "axially" generally mean along or parallel to a central or longitudinal axis, while the terms "radial" and "radially" generally mean perpendicular to a central longitudinal axis. Further, the term "or" is inclusive, meaning, for example "A or B" means either "A," or "B," or "A and B."

While the technology has been described with respect to a limited number of embodiments, those skilled in the art, having benefit of this disclosure, will appreciate that other embodiments may be devised which do not depart from the scope of the technology as disclosed herein. Accordingly, the scope of the technology should be limited by the attached claims.

What is claimed is:

1. A sand accumulator, the sand accumulator comprising:
a housing;
an insert disposed inside the housing, forming a continuous seal with an inner circumference of the housing, and comprising:
an outer sleeve disposed in the housing, forming an annulus between the outer sleeve and the housing, and comprising:
at least one first large flow port; and
a first cap sealing an uphole end of the outer sleeve;
an inner sleeve disposed in the outer sleeve and comprising:
at least one second large flow port; and
a second cap sealing an uphole end of the inner sleeve,
where the outer sleeve and the inner sleeve are axially aligned, in a first position the at least one first large flow port and the at least one second large flow port are aligned in a flow configuration to form a first continuous flow path, and in a second position, the at least one first large flow port and the at least one second large flow port are misaligned, and
where the aligned at least one first large flow port and the at least one second large flow port provides for a fluid flow in the annulus in the uphole direction having a vortex flow.

2. The sand accumulator according to claim 1, where:
the at least one first large flow port comprises a first plurality of large flow ports, and
the at least one second large flow port comprises a second plurality of large flow ports,
where in the first position the first plurality of large flow ports and the second large flow ports align in a flow configuration to form a first continuous flow path through each pair of aligned first large flow ports and second large flow ports.

3. The sand accumulator according to claim 2, where:
the outer sleeve further comprises a first plurality of small flow ports in a region separate from the first plurality of large flow ports; and
the inner sleeve further comprises a second plurality of small flow ports in a region separate from the second plurality of large flow ports,
where in the first position the first plurality of small flow ports and the second plurality of small flow ports are aligned in a flow configuration to form a plurality of second continuous flow paths, and in the second position, the first plurality of small flow ports and the second plurality of small flow ports are misaligned.

4. The sand accumulator according to claim 1, where in the first position the at least one first large flow port and the at least one second large flow port align in a flow configuration such that a first continuous flow path is angled upward and deviated from a central axis of the insert and provides for a vortex flow.

5. The sand accumulator according to claim 1, where the first cap comprises a peak in the uphole direction.

6. The sand accumulator according to claim 1, where the second cap comprises a rupture disk.

7. The sand accumulator according to claim 3, where the first plurality of small flow ports and the second plurality of small flow ports each comprise a sand screen.

8. The sand accumulator according to claim 3,
where the region of the outer sleeve comprising the first plurality of small flow parts is positioned uphole from a region of the outer sleeve comprising the first plurality of large flow ports, and
where the region of the inner sleeve comprising the second plurality of small flow parts is positioned uphole from a region of the inner sleeve comprising the second plurality of large flow ports.

9. The sand accumulator according to claim 1, further comprising:
a spring disposed between a first surface fixed relative to the outer sleeve and a second surface fixed relative to the inner sleeve,
where, in the first position, the inner sleeve is spaced a first distance from the outer sleeve and the spring is compressed, and
where, in the second position, the inner sleeve is spaced a second distance greater than the first distance from the outer sleeve and the spring is extended,
where the spring is configured to compress during fluid flow through the sand accumulator from downhole to uphole and to extend when fluid flow does not occur through the sand accumulator from downhole to uphole.

10. A sand accumulator for a wellbore tubular, the accumulator comprising:
a housing disposed in line with the wellbore tubular such that a continuous seal forms with an outer circumference of the wellbore tubular;
an insert disposed inside the housing such that an annulus is formed between the housing and the insert, where the insert forms a continuous end-to-end seal with a section of the wellbore tubular that is uphole from the sand accumulator, the insert comprising:
an inlet section comprising at least one inlet port configured to permit fluid flow from the annulus to inside the inlet section such that the fluid flow has an uphole component and a tangential component, which provide for a vortex flow to form in the inlet section; and a sand settling basket coupled to the inlet section, the sand settling basket comprising a closed downhole end.

11. The sand accumulator according to claim 10, where at least one of the at least one inlet port is configured such that fluid flow from the annulus comprises a downhole component and a tangential component that provides for a vortex flow in the sand settling basket.

12. The sand accumulator according to claim 10, wherein the sand settling basket comprises a conical shape.

13. A method of protecting downhole equipment in a wellbore tubular from sand entrained in a production fluid, comprising:

introducing the production fluid entrained with sand from downhole of a sand accumulator into the sand accumulator such that the production fluid entrained with sand flows through an at least one radial port such that a vortex flow forms in an insert and the production fluid entrained with sand flows uphole of the sand accumulator, where the sand accumulator has a housing coupled to the wellbore tubular and the insert is disposed in the housing, and where the insert comprises at least one radial port that is configured such that when a fluid flows through the at least one radial port a vortex flow forms;

ceasing the introduction of production fluid entrained with sand into the sand accumulator such that the vortex flow dissipates and sand entrained in the production fluid uphole from the sand accumulator settles into the sand accumulator; and introducing the production fluid entrained with sand from downhole of the sand accumulator into the sand accumulator such that the production fluid entrained with sand fluid flows through the at least one radial port, the vortex flow forms in the insert, the production fluid entrained with sand flows uphole of the sand accumulator, and that the accumulated sand in the sand accumulator is entrained in the vortex flow in the insert and flows uphole with the production fluid entrained with sand such that the production fluid entrained with sand uphole of the sand accumulator has a greater concentration of entrained sand than the production fluid entrained with sand downhole of the sand accumulator.

14. The method according to claim 13, where introducing the production fluid entrained with sand from downhole of the sand accumulator into the sand accumulator flows the fluid from an interior space of the insert through the at least one radial port into an annulus of the sand accumulator formed between the housing and the insert.

15. The method according to claim 14, where introducing the production fluid entrained with sand from downhole of the sand accumulator into the sand accumulator moves an inner sleeve of the insert relative to an outer sleeve of the insert, where at least one first port of the at least one radial port is disposed through the outer sleeve and at least one second port of the at least one radial port is disposed through the inner sleeve, and where moving the inner sleeve relative to the outer sleeve aligns the at least one first port and the at least one second port to form a first flow pathway while flowing the fluid uphole.

16. The method according to claim 15, where moving the inner sleeve relative to the outer sleeve aligns the at least one first port and the at least one second port compresses a spring, where the spring is coupled to both the inner sleeve and the outer sleeve, and where aligning the at least one first port and the at least one second port further comprises aligning a plurality of large flow first ports disposed on the outer sleeve with a plurality of large flow second ports disposed on the inner sleeve, each of which forms a first flow pathway, and aligning a plurality of small flow first ports disposed on the outer sleeve with a plurality of small flow second ports disposed on the inner sleeve, each of which forms a second flow pathway.

17. The method according to claim 13, where introducing the production fluid entrained with sand from downhole of the sand accumulator into the sand accumulator flows the fluid through the at least one radial port such that the fluid flows from an annulus of the sand accumulator into an interior space of the insert.

18. The method according to claim 17, where at least one of the at least one radial port has a helical orientation such that upon introduction of the fluid from downhole of the sand accumulator into the sand accumulator a vortex flow forms in the interior space of the insert.

19. The method according to claim 17, where at least one of the at least one radial port is configured such that it has a helical orientation with a downhole component and a tangential component in a direction toward or away from the annulus such that upon introduction of the production fluid entrained with sand from downhole of the sand accumulator into the sand accumulator a vortex flow forms in the interior space of the insert.

20. The method according to claim 17, wherein sand accumulator further comprises a sand settling basket in a closed, downhole end of the insert.

* * * * *